US005782371A

United States Patent [19]

Baerenwald et al.

[11] Patent Number: 5,782,371

[45] Date of Patent: Jul. 21, 1998

[54] METAL CONTAINER HAVING RESILIENT HINGED CONNECTOR

[75] Inventors: Philip M. Baerenwald, Rockton; David K. Bried, Loves Park; Alfred L. Gray, Belvidere; George Solowiejko; Gary D. Johnson, both of Rockford, all of Ill.

[73] Assignee: J. L. Clark, Rockford, Ill.

[21] Appl. No.: 810,871

[22] Filed: Mar. 5, 1997

[51] Int. Cl.[6] ..... B65D 6/00

[52] U.S. Cl. ..... 220/4.22; 220/4.24; 16/DIG. 13

[58] Field of Search ..... 220/4.22, 4.23, 220/4.24, 334, 339; 16/DIG. 13

[56] References Cited

U.S. PATENT DOCUMENTS

| | | | |
|---|---|---|---|
| 3,944,105 | 3/1976 | Chollet | 220/4.24 |
| 4,351,165 | 9/1982 | Gottsegan et al. | 220/4.24 X |
| 4,452,373 | 6/1984 | Pearce et al. | 220/4.22 X |
| 4,546,874 | 10/1985 | Kirchhan | 220/4.24 X |
| 5,676,272 | 10/1997 | Baerenwald | 220/4.24 |

*Primary Examiner*—Steven M. Pollard
*Attorney, Agent, or Firm*—Leydig, Voit & Mayer, Ltd.

[57] ABSTRACT

A unitary hinged connector connects a metal container lid and a metal container bottom to form a hinged container. The metal lid and bottom have matching formed edges which may be identical in shape or interfitting. The hinged connector is formed of molded thermoplastic and includes a ring member, a swingable partial segment, and an integrally formed hinge joining the ring member and the partial segment. The ring member, which is substantially continuous about the periphery, is normally attached to the formed edge of the container bottom, and has an upper seat for engaging less than all sides of the formed edge of the lid when the container is closed, leaving a hinge side of the formed edge free. The swingable partial segment securely grips at least the hinge side of the formed edge of the lid. The hinge is positioned to close the container in a normal condition and allow the container lid to pivot about the hinge to open the container.

29 Claims, 8 Drawing Sheets

METAL CONTAINER HAVING RESILIENT HINGED CONNECTOR

FIELD OF THE INVENTION

This invention relates generally to containers, and more specifically to thin-walled metal containers with formed edges.

BACKGROUND OF THE INVENTION

Thin-walled metal containers are popular for packaging certain items, where the packaging is intended to have a degree of permanency. They are advantageous in that they provide good protection for the contents, and they provide the opportunity to permanently print attractive designs on the containers themselves. The containers thus can be used for long periods of time, or, in cases where the contents are consumed after a short time, the containers are often kept for other storage purposes.

Thin-walled metal containers are typically made from thin metal sheets by deep drawing. Some of them have separable lids and bottoms, while others, including many low-profile containers, have hinged lids that are not separable from the bottoms. Both hinged and non-hinged metal containers share the aspect that the lids are not identical to the bottoms, because they are intended to interfit. Thus, two different tool sets are normally required to form a container, one for making the container lid, the other for the bottom. Typically, the bottom has an edge which is inwardly rolled or hemmed to avoid exposing raw metal edges, and sometimes has a ledge formed at the upper part to serve as a receiving area/stop for the lid. The lid or cover typically has a rolled or hemmed edge to also avoid exposing raw metal edges, and that edge is typically rolled outwardly, to leave the inside wall of the lid available to fit the container bottom. In the case of a hinged container, the lid further has a hinge half that interfits an associated hinge half on the container bottom.

The hinged connection between the lid and the bottom of a hinged container facilitates repeated opening and closing of the container and also eliminates the possibility of mislaying the container lid. Hinged containers, however, are generally more expensive to make than non-hinged containers with separable container halves, due to the costs involved in forming the hinges. For example, the hinge on a low-profile metal container is typically integrally formed from metal tabs extending from the sides of the container halves. To form such a hinge, the sheet metal blank from which a container half is formed has to be processed to form the tabs, and the tabs are then rolled or otherwise processed to form a hinge half. Although the exact configurations of hinges on hinged metal containers may differ, the formation of such hinges generally requires extra metal processing steps and more complicated tool sets than those required for non-hinged metal containers.

The tool sets and machine setups for making a particular metal container can involve a significant expense. That expense can be justified when production runs are relatively long, so that the same tool sets can be used to produce a large number of container components. It is not straightforward or inexpensive to change tool sets or machine setups to change from one size container to another. For example, when it is desired to form a shallower or taller container, it is necessary to alter the drawing and forming tools which, as pointed above, can be expensive. This problem is even more significant in the case of hinged containers, due to the relatively more expensive tool sets and more complicated setups required for making them. Thus, when a packaging application has a requirement for the possibility of size changes over the life of the product, the increased manufacturing costs of metal containers could lead a customer to consider the use of other more conventional and less expensive types of packaging formed of plastic or paper. While a container can conceptually be made utilizing two identical container halves produced using the same equipment in order to reduce costs, the identical halves cannot interfit to form a container in general, and cannot be readily combined to form a hinged container in particular.

SUMMARY OF THE INVENTION

In view of the foregoing, it is a general object of the present invention to provide a metal container with a hinged lid that can be produced at a relatively low cost by avoiding the need for extra metal working steps and complicated and expensive tool sets for forming the hinge.

It is a resultant object of the present invention to provide a cost-effective hinge mechanism that can be used to hingedly connect two container halves to form a container without having to form hinge components separately on the container halves.

It is a related object of the invention to provide a hinge mechanism that can be used to combine two identical container components, such as two container lids, to form a low-profile hinged metal container, so that only one set of tools is required to form the metal container, thereby reducing the manufacturing cost of the container.

It is another related object of the invention to provide a hinge mechanism that can be used to convert a conventional, non-hinged, container into a hinged container.

It is a further related object of the present invention to provide such a hinge mechanism that is simple in structure, reliable in operation, and inexpensive to manufacture.

It is an object according to a particular aspect of the invention to exploit the characteristics of the mechanism used to join two container halves to form a hinged container by using the mechanism to add internal and external features.

According to these and other objects of the present invention, there is provided a resilient hinged connector for joining a metal container lid and a metal container bottom to form a hinged container. The container lid and bottom are typically formed of drawn sheet metal and each has a closed end and an upstanding wall terminated in a formed edge. The formed edges of the container lid and bottom define a peripheral container shape. The hinged connector is shaped to generally match the peripheral container shape or a portion thereof and comprises a ring member, a partial segment, and an integrally formed hinge joining the ring member and the partial segment. The ring member is preferably substantially continuous about its periphery and has a down-facing seat for gripping the formed edge of the container bottom, and an up-facing seat for gripping fewer than all sides of the formed edge of the container lid, leaving at least one side of formed edge of the lid free. The partial segment has an up-facing seat which is sized for securely gripping at least the free side of the formed edge of the container lid. The integrally formed hinge is positioned to close the container in a normal condition and allow the container lid to pivot about the hinge to open the container. The hinged connector is preferably formed of injection molded thermoplastic, which is relatively inexpensive to produce.

It is a feature of the present invention to use a resilient connector with an integrally formed hinge to join two container halves to form a hinged container. Thus, the lid and bottom have simple formed edges, and the need to form hinge components separately on the container halves is avoided, resulting in substantial reduction of the cost of the hinged container.

It is another feature of the present invention that, by virtue of the connector, the container halves do not have to interfit, and may have identical size and shape. In the currently preferred implementation, two identical regular container lids with simple formed edges are joined together by a hinged connector to form a low-profile hinged container. Using identical container halves further reduces the cost of the container, since both container halves can be formed using the same tools.

It is another feature of the present invention that the hinged connector can be advantageously used to join the lid and bottom of a conventional non-hinged container to form a hinged container. Thus, existing non-hinged metal containers can be readily converted into hinged containers.

Other objects and advantages will become apparent with reference to the following detailed description when taken in conjunction with the drawings in which.

Figure 1:
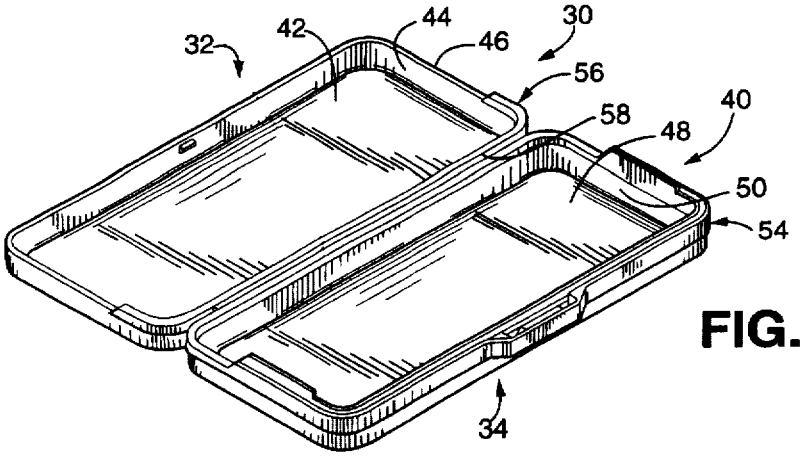
FIG. 1 is a perspective view of a container with two container halves joined by a resilient connector which has an integrally formed hinge.

While the invention is susceptible of various modifications and alternative constructions, certain illustrated embodiments hereof have been shown in the drawings and will be described below. It should be understood, however, that there is no intention to limit the invention to the specific forms disclosed, but, on the contrary, the invention is to cover all modifications, alternative constructions and equivalents falling within the spirit and scope of the invention as defined by the appended claims.

DETAILED DESCRIPTION OF THE PREFERRED EMBODIMENT

Figure 5:
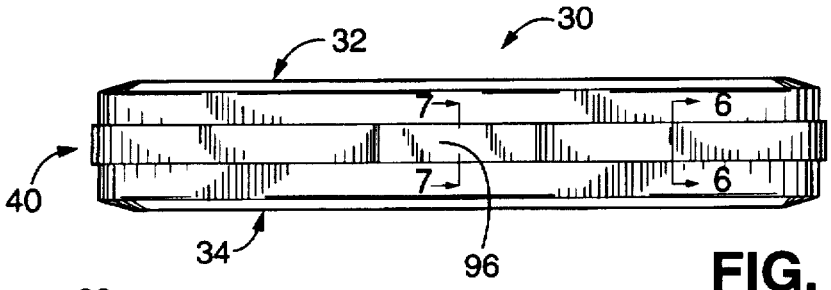
FIG. 5 is a front elevation of the container in a closed position.
Figure 6:
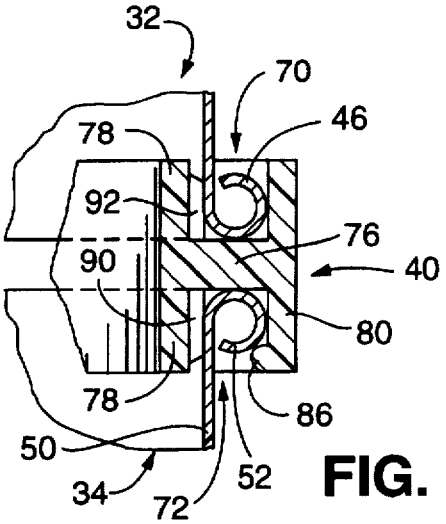
FIG. 6 is an enlarged fragmentary cross sectional view of the container along the line 6—6 in FIG. 5.

Turning now to the drawings, FIG. 1 shows a container 30 constructed according to the teaching of the present invention. A front view of the closed container is shown in FIG. 5. The container has a container lid 32 and a container bottom 34 joined by a resilient hinged connector 40 to form a hinged container. Each of the container lid 32 and bottom 34 has a thin metal body which is typically formed by deep drawing. The container lid has a closed end 42, an upstanding wall 44, and a formed edge 46. Likewise, the container bottom has a closed end 48, an upstanding wall 50, and a formed edge 52 (FIG. 6). The formed edge 46 of the container lid matches the formed edge 52 of the container bottom. The term "match" thus used is intended to indicate that the two formed edges either interfit, or have substantially identical peripheral size and shape. In the latter case, the two edges need not be identically formed. For example, the edge of the lid may be an outwardly curled edge, while the edge of the bottom may be a hemmed edge. The formed edges define a general peripheral container shape. Because neither of the container halves 32,34 has any hinge component formed directly thereon, the container halves cannot be directly combined to form a hinged container.

In accordance with a feature of the present invention, the resilient hinged connector 40 is provided as an inexpensive yet effective interface between the container lid 32 and bottom 34 so that they can be hingedly joined to form a closed container. The connector 40 is shaped to match the peripheral container shape and has seats for fitting the formed edges of the container halves. As illustrated in FIG. 1, the connector 40 comprises a ring member 54 which is normally attached to the container bottom 34, and a swingable partial segment 56 which is securely attached to the container lid 32. The ring member 54 and the partial segment 56 are connected by a hinge 58 which is integrally formed with the partial segment and the ring member. By virtue of the hinge 58, the container lid 32 can be pivoted about the hinge side of the container bottom 34. Because the hinge 58 is an integral part of the connector 40, there is no need to form separate hinge components directly on the container halves. Thus, the container halves have simple formed edges which are relatively inexpensive to form. The connector 40 is preferably made of molded thermoplastic material, which preferably is polypropylene. Because the molded plastic connector is fairly inexpensive to produce, the hinged container 30 utilizing the hinged connector 40 can be substantially less expensive than conventional all-metal hinged containers.

Figure 2:
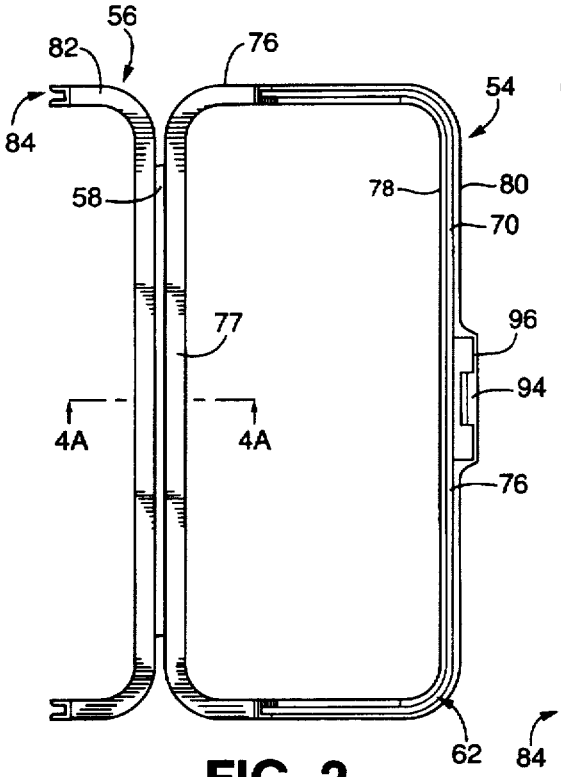
FIG. 2 is a top view of the hinged connector in a fully open position.
Figure 3:
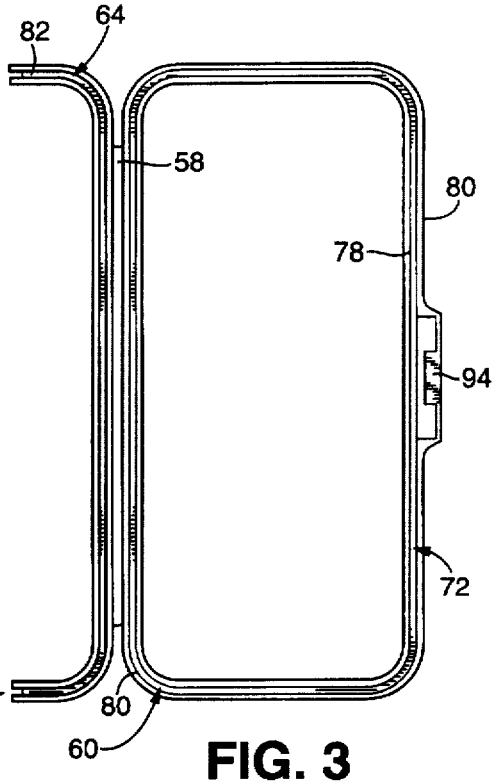
FIG. 3 is a bottom view of the hinged connector in the fully open position.

FIG. 2 shows a top view of the hinged connector 40 with the connector in a "fully open" position. In this position, the partial segment 56 is swung about 180 degrees away from its closed position where it is folded onto the ring member 54. A bottom view of the connector 40 in the fully open position is shown in FIG. 3. Both the ring member 54 and the partial segment 56 are sized and shaped to match the peripheral container shape defined by the formed edges of the container halves. The ring member 54 has a down-facing lower seat 60 for receiving the formed edge of the container bottom, and an up-facing upper seat 62 for receiving less than all sides of the formed edge of the container lid, leaving at least one side of formed edge free. The swingable partial segment 56 has a seat 64 which faces up when the partial segment 56 is in the closed position, although it appears to be facing down in the fully open position shown in FIG. 3. The seat 64 is sized for securely gripping at least the free side (the side not received by the upper seat of the ring member) of the formed edge of the container lid. The integrally formed hinge 58 is positioned such that the formed edge of the container lid is received by both the upper seat 62 and the seat 64 of the partial segment when the container is closed. When the container is open, the formed edge 46 of the container lid 32 is disengaged from the upper seat 62, but is still held by the seat 64 of the partial segment to allow the container lid to pivot about the hinge 58.

In the present embodiment, the ring member 54 has a continuous body corresponding to the entire periphery of the container halves. It will be appreciated, however, that the ring member 54 need not be a continuous piece, and may comprise separate segments. In such a case, the overall shape of the ring member 54 will be maintained by the formed edge 52 of the container bottom 34.

Figure 4A:
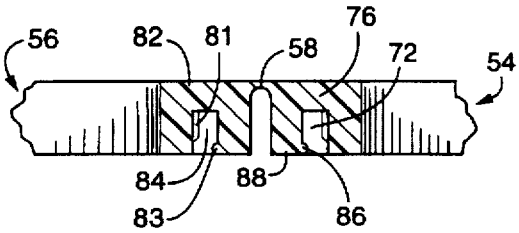
FIG. 4A is an enlarged fragmentary cross sectional view of the hinge portion of the hinged connector when the connector is in the fully open position.
Figure 4B:
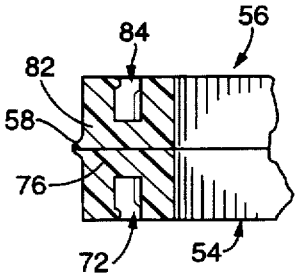
FIG. 4B is an enlarged fragmentary cross sectional view of the hinged portion when the connector is in a closed position.

In the present embodiment, all of the three seats 60, 62, 64 on the ring member 54 and the partial segment 56 are in the form of channels. As illustrated, the ring member 54 has an upper channel 70 and a lower channel 72 separated by a base 76 (see also FIG. 6) which has the form of a web. The ring member 54 includes an inner peripheral wall 78 and an outer peripheral wall 80 which are connected by the base 76 to form the upper and lower channels 70, 72. The partial segment 56 similarly has a base 82 and a channel 84 extending upwardly from the base 82. As illustrated in FIG. 2, the upper side of the base 76 of the ring member 54 along the hinge is open for receiving the base 82 of the partial segment 56. As can be best seen in the cross sectional view of FIG. 4A, the base 82 of the swingable segment is connected to the base 76 of the ring member by the hinge 58. The hinge 58 is in the form of a thin, flexible web which allows the partial segment 56 to pivot about the hinge. As illustrated in FIG. 4B, when the partial segment 56 is pivoted to the closed position, its base 82 overlies the open section of the base 76 of the ring member 54. In this position, the channel 84 of the partial segment cooperates with the upper channel 70 the ring member for receiving the formed edge 46 of the container lid 32.

When the container is open, it is intended that the ring member 54 remains fixed on the container bottom 34, and the partial segment remains attached to the container lid 32, as illustrated in FIG. 1. To that end, it is often preferred to configure the channels to have different gripping characteristics so that the lower channel 72 and the channel 84 of the partial segment are capable of holding the respective formed edges of the container more firmly than does the upper channel 70 to the formed edge of the lid. In this way, the upper channel 70 will release the container lid 32 before other channels release the associated formed edges when a user attempts to open the container. As thus used, "gripping" is broadly intended to extend from a relatively secure snap fit as will be discussed below to a relatively loose sliding fit.

Turning now to FIG. 6, in the present embodiment, the lower channel 72 has gripping means for firmly capturing the formed edge 52 of the container bottom when inserted therein. The gripping means in the lower channel 72 includes a plurality of detent protrusions and "crush" ribs. The detent protrusions are used to relatively rigidly attach the ring member 54 to the formed edge 52 of the container bottom. As illustrated, the detent protrusions in the lower channel include nibs 86 protruding from spaced locations on the wall 80 into the channel 72. The nibs 86 re located at a predetermined height from the base 76 such that they snap on and capture the formed edge 52 of the container bottom 34 when inserted therein. Instead of using a series of nibs 86 disposed at selected locations, it is also possible to use a continuous nib on the wall 80 extending around the lower channel to capture the formed edge of the container bottom. The illustrated gripping means in the lower channel 72 also includes a plurality of crush ribs 90 located at selected locations around the lower channel. The crush ribs 90 project from the wall 80 into the lower channel. When the formed edge 52 of the container bottom is inserted into the lower channel, the crush ribs engage and press on the inner surface of the upstanding wall 50 of the container bottom adjacent to the formed edge 52. The crush ribs 90 thus firmly hold the formed edge 52 towards the detent nibs 86 such that the formed edge is securely captured by the nibs. As illustrated in FIG. 4A, similar nibs 83 and crush ribs 81 may be formed in the channel 84 on the swingable segment 56 so that the channel is capable of firmly gripping the formed edge of the lid 32.

If a snug frictional fit without detent is desired, then the nibs can be eliminated to use only the crush ribs for gripping the formed edge. For example, in the present embodiment as illustrated in FIG. 6, the upper channel 70 is provided with crush ribs 92 to provide a frictional fit with the edge 46 of the container lid 32. It will be appreciated that other types of gripping means can also be employed in the channels to provide the desired gripping characteristics.

In accordance with an important feature and application of the invention, in the present embodiment the formed edges 46, 52 of the container lid 32 and bottom 34 are substantial identical. The lid 32 and bottom 34 therefore normally do not interfit and cannot be directly combined to form a closed container. Thus, the hinged connector is advantageously used to join such container halves to form a hinged, closed container. Although the formed edges may be identical, the container lid and bottom need not be identical. For instance, two regular container lids with an identical peripheral shapes and identically formed edges but different heights may be combined by means of the connector 40 to form a low profile container. It is, however, presently preferred to use two identical container halves, such as two regular container lids, to form a hinged container in order to take advantage of the reduced fixed cost due to the use of the same tools to produce both container halves.

Figure 7:
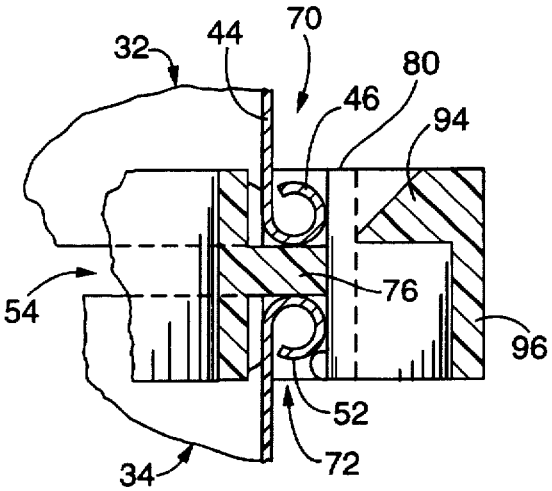
FIG. 7 is an enlarged fragmentary cross sectional view of the container along the line 7—7 in FIG. 5.

As an ancillary feature of the present invention, the connector 40 has an integrally formed wedge for facilitating the opening of the container. Referring back to FIG. 2, the wedge 94 is supported on a U-shaped web 96 integrally formed with the ring member 54 and disposed across the ring member from the hinge 58. FIG. 7 shows a cross sectional view of the closed container 30 in FIG. 5. As illustrated therein, the upper portion of the outer wall 80 is relieved between the two legs of the U-shaped web 96 so that the formed edge 46 of the container lid 32 is exposed. The wedge 94 is supported on the U-shaped web 96 such that the tip of the wedge points towards the gap between the formed edge 46 of the container lid 32 and the base 76. A user attempting to open the container simply pushes on the web 96 as indicated by the arrow 98 towards the ring member 54, and the wedge 94 is inserted between the formed edge 46 and the base 76 to pry the lid 32 out of the upper channel 70, thereby opening the container.

Figure 8:
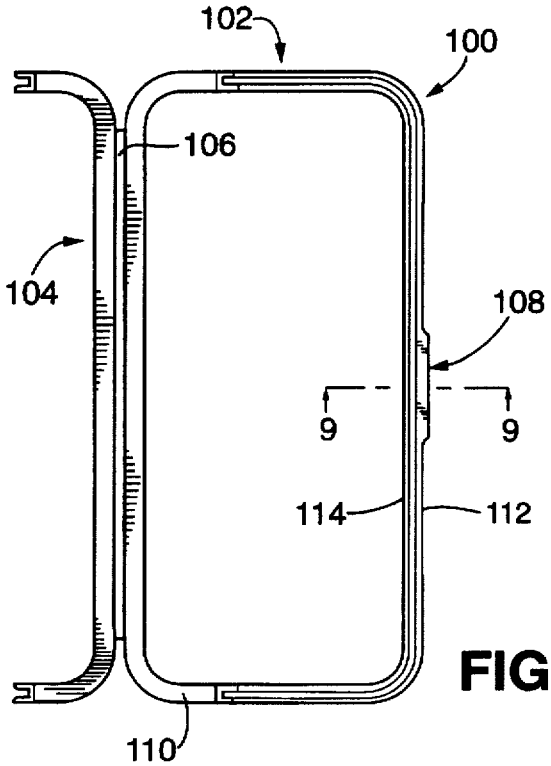
FIG. 8 is a top view of an alternative embodiment of a hinged connector.
Figure 9:
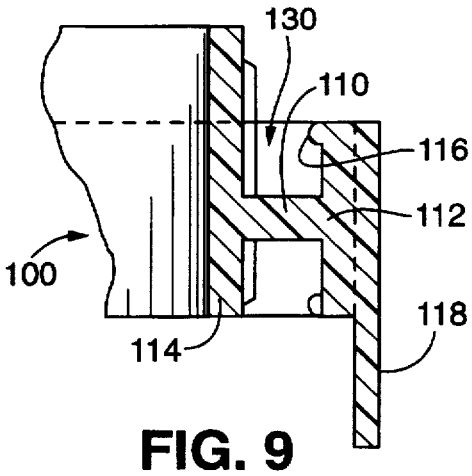
FIG. 9 is an enlarged fragmentary cross sectional view of the hinged connector in FIG. 8 along the line 9—9.

FIG. 8 shows a top view of an alternative embodiment of the hinged connector. Like the embodiment described above, the connector 100 has a ring member 102 and a partial segment 104 joined by an integrally formed hinge web 106. In this embodiment, the ring member 102 has a latch section 108 located across the ring from the hinge web 106. As shown in the cross sectional view of FIG. 9, the outer wall 112 of the ring member in the latch section has an integrally molded, downward depending, release tab 118 on the outside, and a detent nib 116 on the inside protruding into the upper channel 130 for capturing the formed edge of a container lid.

Figure 10:
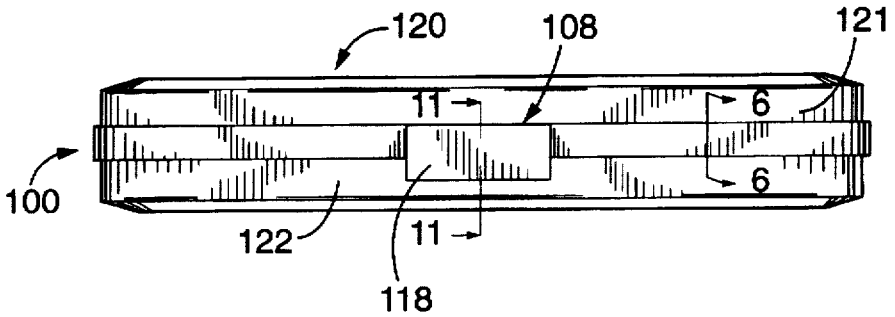
FIG. 10 is a front view of a container formed with the connector in FIG. 8.
Figure 11:
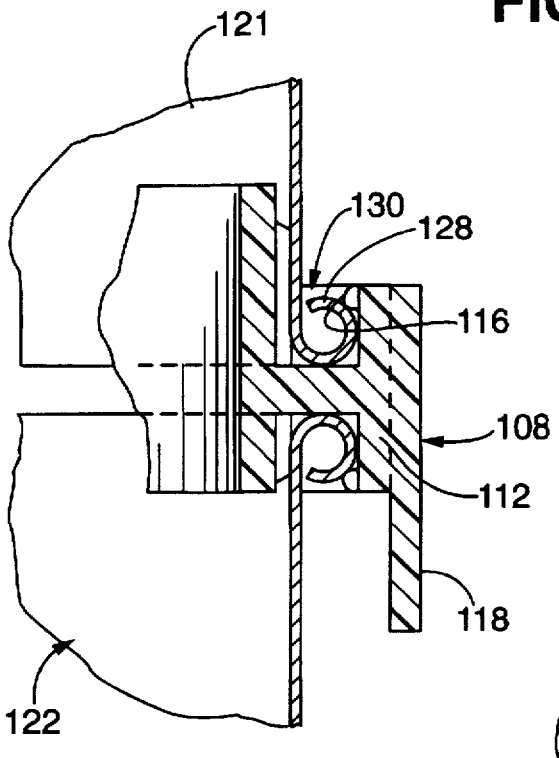
FIG. 11 is a cross sectional view of the container in FIG. 10 along the line 11—11.

FIG. 10 shows a front view of a container 120 formed by joining two identical container halves 121, 122 with the hinged connector 100. FIG. 11 shows a cross sectional view of the closed container 120 along the line 11—11 in FIG. 10. As illustrated, the formed edge 128 of the container lid 121 is received in the upper channel 130 of the ring member, and the detent nib 116 in the latch section grips the formed edge to resist the removal of the formed edge from the upper channel, thereby maintaining the container lid in the closed position.

Figure 12:
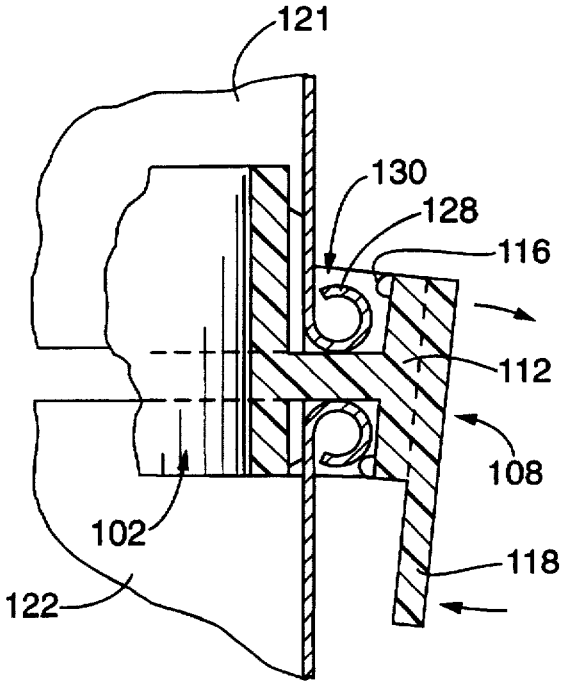
FIG. 12 is similar to FIG. 11 but illustrates the operation of a latch mechanism for releasing the container lid from the connector.

The operation of the latch section 108 to allow the container to be easily opened is illustrated in FIG. 12. When a user attempts to open the container by pushing on the release tab 118, the outer wall 112 is twisted so that the upper portion of the outer wall moves outwardly sufficiently so that the detent nib 116 is disengaged from the formed edge 128 of the container lid. In this way, the detent nib 116 would not obstruct the removal of the formed edge 128 of the container lid from the upper channel 130 of the ring member. The container lid 121 may then be easily removed from the upper channel 130 to open the container.

Figure 13:
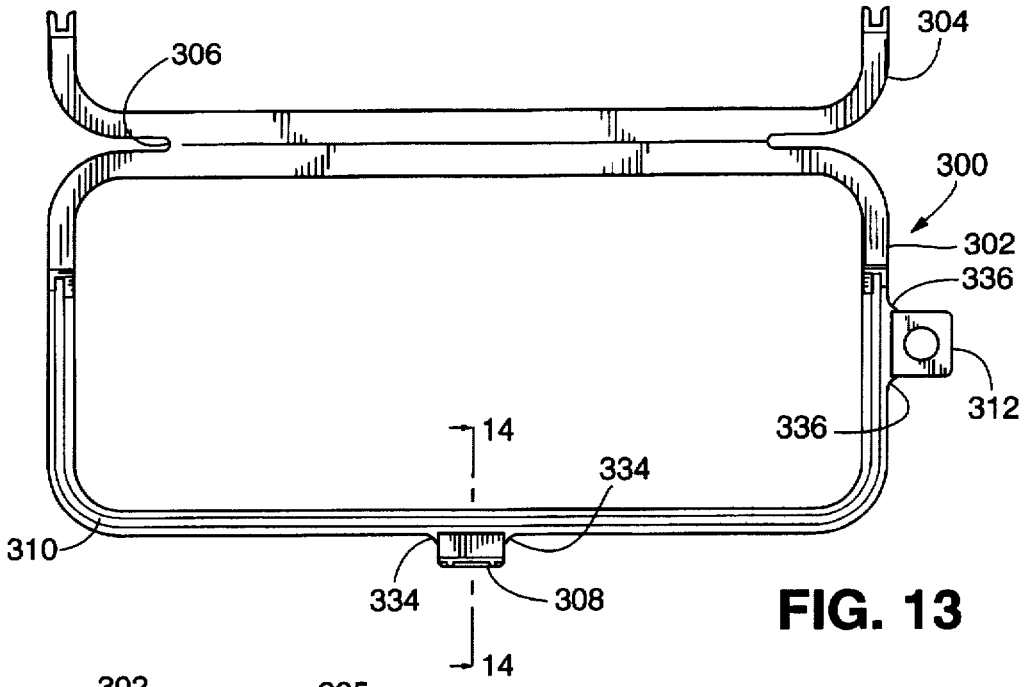
FIG. 13 is a top view of an alternative embodiment of a hinged connector which has an integrally formed clasp and a hanging tab.
Figure 14:
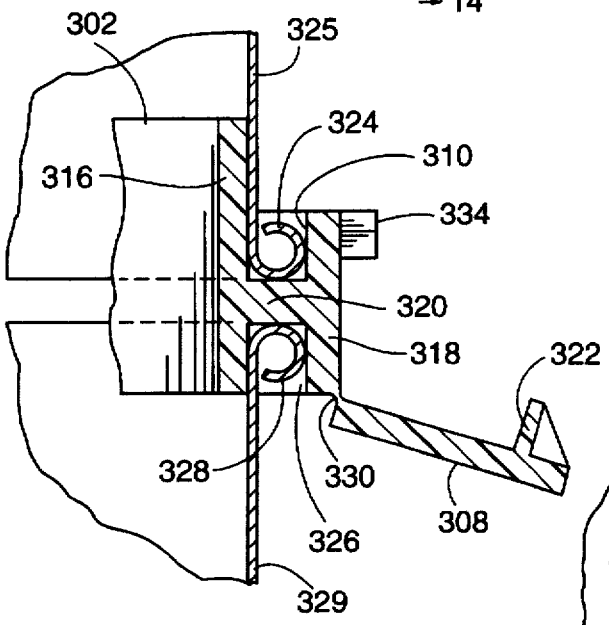
FIG. 14 is a fragmentary cross sectional view of the hinged connector of FIG. 13 joining two connector halves.
Figure 15:
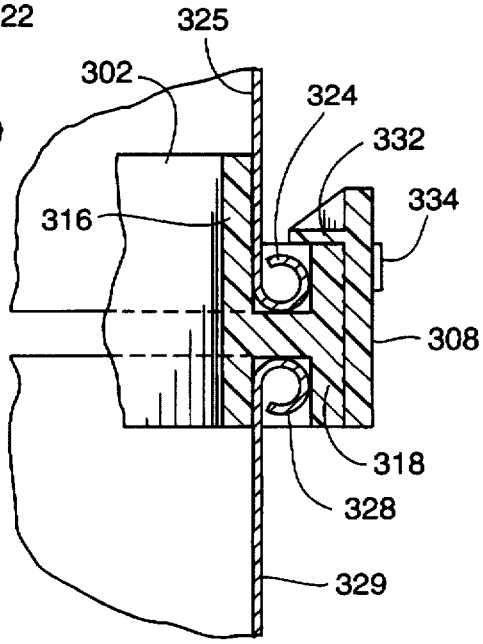
FIG. 15 is a fragmentary cross sectional view similar to FIG. 14 but with the clasp of the hinged connector in a locking position.

FIGS. 13–15 show another alternative embodiment of a hinged connector 300. As illustrated in FIG. 13, the connector 300, like the two embodiments described above, includes a ring member 302 and a partial segment 304 joined by an integrally formed hinge web 306. As a feature of this embodiment, the connector 300 has a clasp 308 integrally formed on the ring member 302 for holding the formed edge of a container lid in the upper channel 310 of the ring member. The connector 300 is also provided with a hanging tab 312 integrally formed on the ring member 302. The hanging tab 312 has a hole formed therein which can be used to hang the container formed with the connector 300 on a peg or the like for display or storage purposes.

FIG. 14 shows a cross sectional view of a container formed with the hinged connector 300. As illustrated, the ring member 302 has an inner wall 316 and an outer wall 318 connected by a base web 320 to form an upper channel 310 for receiving the formed edge 324 of the container lid 325 and a lower channel 326 for receiving the formed edge 328 of the container bottom 329.

The clasp 308 and the hanging tab 312 are preferably integrally molded on the outer periphery of the ring member 302. In the illustrated embodiment, the clasp 308 is pivotally connected to the lower end of the outer wall 318 of the ring member by a thin web 330. The free end of the clasp 308 is formed into a latch head 332. The outer wall 318 of the ring member is provided with two detent tabs 334 which are arranged to provide a snap-in fitting with the clasp 308 such that they hold the clasp tightly when the latter is moved into a locking position abutting the outer wall 318 of the ring member. The hanging tab 312 (FIG. 13) is similarly pivotally connected to the outer wall 318 of the ring member so that it can be folded against the outer wall 318 when not in use. Two detent tabs 336 are provided on the outer wall for holding the hanging tab 312 in the folded position.

As can be best seen in FIG. 15, when the clasp 308 is in the illustrated locking position, the latch head 332 extends over the upper channel 310 of the ring member 302. In this position, the latch head 332 prevents the formed edge 324 of the container lid from being disengaged from the upper channel 310 of the ring member, thereby locking the container lid in the closed position.

Figure 16:
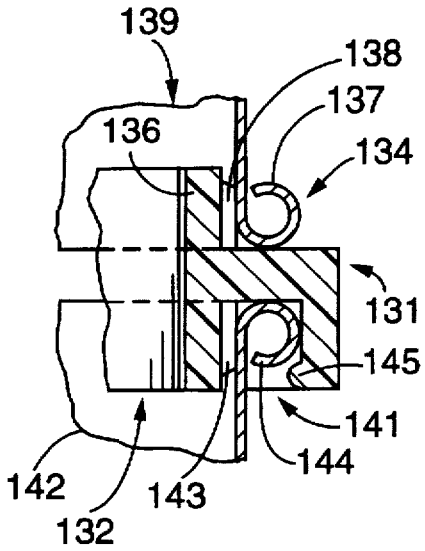
FIG. 16 is a fragmentary cross sectional view showing another alternative embodiment of the invention.

FIG. 16 shows an alternative embodiment of a hinged connector 131. In FIG. 16, only the section of the ring member 132 on the opposite side of the hinge is illustrated. In this embodiment, the upper seat 134 on the ring member has only one upstanding wall 136 instead of two walls forming a channel. Crush ribs 138 are formed on the wall to provide a snug frictional fit between the wall 136 and the wall of the container lid 139 adjacent the formed edge 137. The frictional fit allows the container lid 139 to be released from the upper seat 134 with relative ease. In contrast, the lower seat 141 on the ring member is in the form of a channel with gripping means such as crush ribs 143 and nibs 145 so that the ring member 132 is attached securely to the formed edge 144 of the container bottom 142. In different applications, depending on the use of the container, it may be desirable that both the upper and lower seats, or even the seat on the partial segment, be formed to have only one upstanding wall. The seats may also be formed to have shapes other than a channel or an upstanding wall to provide the desired gripping characteristics.

In the above described embodiments, the edges of the containers are formed to eliminate any exposed raw edges of the sheet metal making up the container halves. The formed edges also rigidities the container halves by providing a channel-like structure at the open end. They also provide a container feature to which the connector can be readily adapted. When used therein, the term "formed edge," unless otherwise indicated by the context, is intended to encompass the various metal forming techniques that can be used to shape the container edge. For illustration purposes, the formed edges of the containers described above are in the form of outwardly turned curled edges. It will be appreciated, however, that the invention also has applicability to other types of formed edges, such as teardrop-shaped or hemmed edges, both of which are broadly encompassed within the term formed edge. In addition, the edges can also in most cases be inwardly formed.

Figure 17:
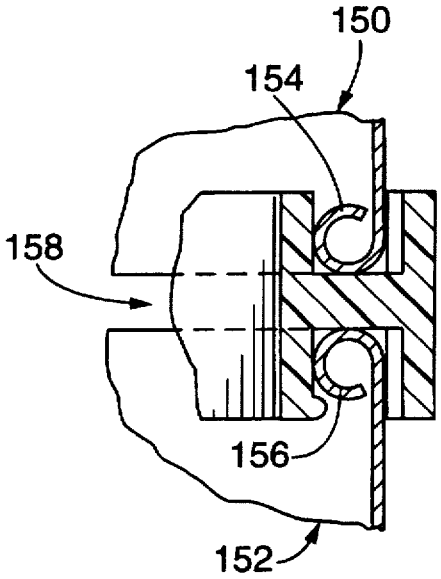
FIG. 17 is a fragmentary cross sectional view illustrating the use of a container with inwardly turned formed edges.

For example, FIG. 17 is a partial view showing the application of the present invention to a container which has metal edges curled inwardly rather than outwardly. Thus, there is shown a container lid 150 and a container bottom 152 having formed edges 154, 156 joined by a connector 158. The edges 154, 156 are curled inwardly to provide a substantially planar outer wall and a curled inner wall. In view of the forgoing disclosure, the manner of configuring the hinged connector to interface with such formed edges will be apparent.

Figure 18:
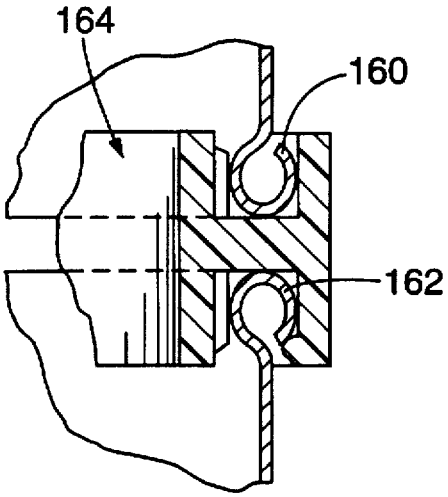
FIG. 18 is a fragmentary cross sectional view illustrating the use of a container with teardrop-shaped formed edges.
Figure 19:
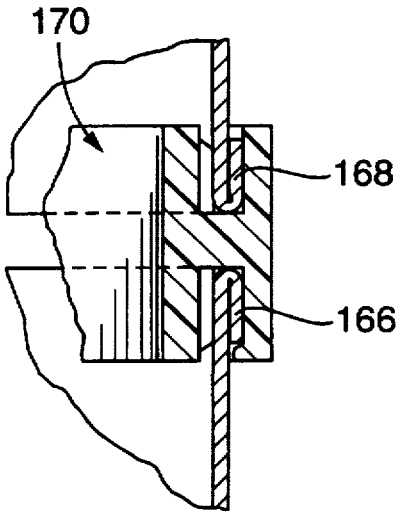
FIG. 19 is a fragmentary cross sectional view illustrating the use of hemmed edges.

FIG. 18 illustrates application of the invention to a container in which the edges 160, 162 are formed to have a teardrop-shaped cross section and are joined by a connector 164. The teardrop-shaped edges present a configuration in which the upstanding walls of the channels are both in contact with contoured portions of the formed edges, in contrast to the prior embodiments where one wall of the channel would be in contact with a curved edge, and the other wall would be in contact with a substantially flat portion of the edge. FIG. 19 shows yet a further embodiment in which the formed edges 166, 168 are hemmed, and the hemmed edges are joined by a connector 170. The hemmed edges 166, 168 present a much flatter profile, in which the forming of the edges folds and then compresses the edge seam.

The hinged connector of the present invention not only serves the function of joining two container halves to form a hinged container, but also presents the opportunity to add additional features to the container. Advantages could be taken of the injection molded connector by forming the connector to include internal or external features for a variety of special purposes.

Figure 21:
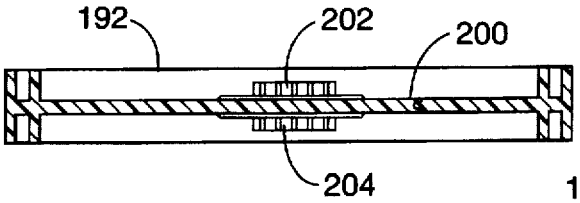
FIG. 21 is a cross sectional view of the connector of FIG. 20 taken along the line 21—21 showing internal features of the connector.
Figure 20:
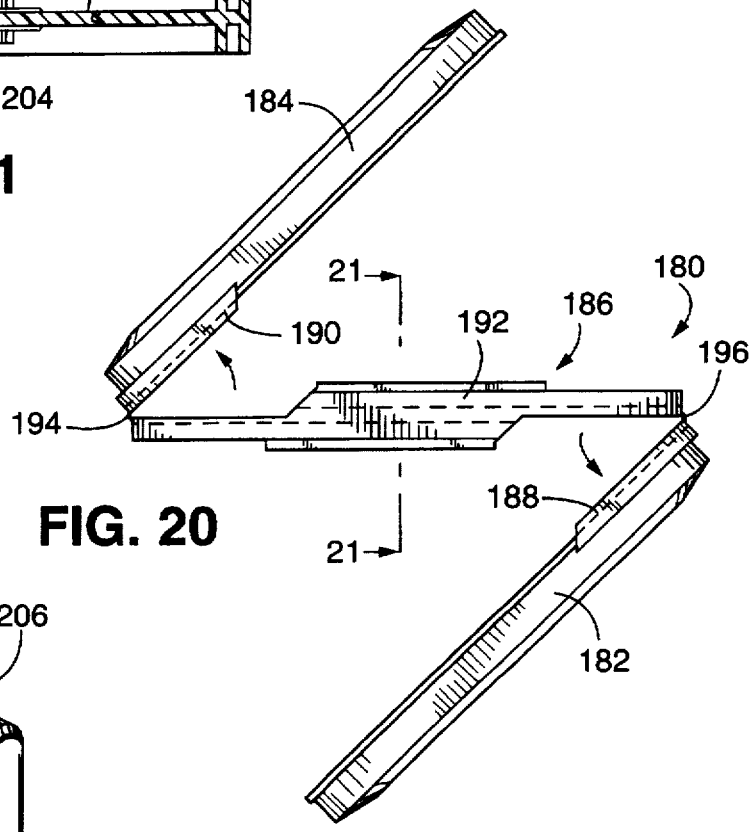
FIG. 20 is a side elevation of a container utilizing a hinged connector having two swingable sections.

An example of a container utilizing a connector with internal features is illustrated in FIG. 20. The container 180 in this embodiment has two substantially identical container halves 182, 184 with a generally square peripheral shape. The connector 186 has two swingable segments 188, 190 connected to a ring member 192 by hinge webs 194, 196. Each partial segment is securely attached to a container half by gripping the formed edge of the container half. Thus, each container half is hinged on the connector 186, and the container can be opened from either side. FIG. 21 shows a cross sectional view of the ring member 192 illustrating the internal feature of the connector. The internal feature comprises a base plate 200 of a substantially square shape and two rosettes 202, 204, one at the center of each side of the base plate 200. The width of the base plate 200 is preferably slightly larger than the diameter of conventional compact discs, and the rosettes 202, 204 preferably are shaped to provide an interfering fit with the central hole of a compact disc. Thus, the metal container 180 formed with the plastic connector 186 provides a commercially attractive low-profile compact disc packaging which can be used for holding two compact discs.

Figure 22:
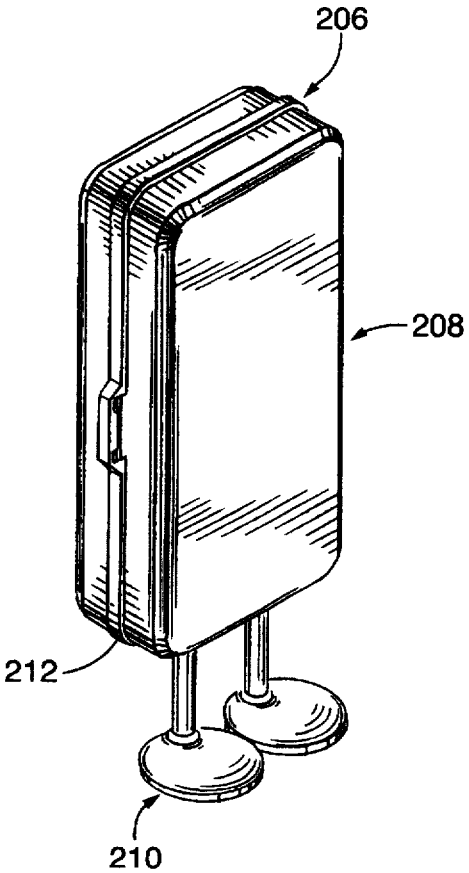
FIG. 22 is a perspective view showing an example of the invention having decorative external features on a hinged connector.

FIG. 22 illustrates the utilization of special purpose external features on a connector 206 for support of the container 208 formed utilizing the connector. In this example, the connector 206 has two special-purpose supports 210 molded integrally with the connector 206 on the side of the ring member 212, so that the supports can be used to stand the container on end on a flat surface. Other types of ornamental or functional external features, of course, can be formed on the connector.

Figure 23:
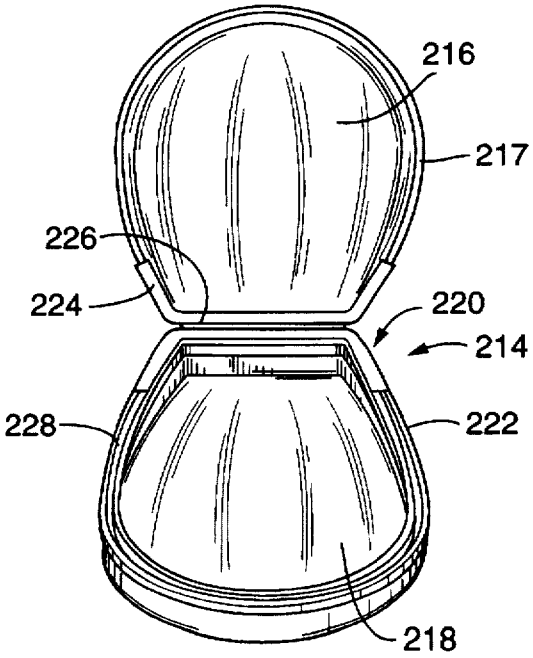
FIG. 23 is a perspective view of a container of a fanciful, non-rectangular, shape.

The invention thus far has been described in connection with rectangular or square containers in order to simplify the drawings and allow the description to focus on important aspects of the invention. It will be recognized that the invention is also suitable to containers of complex or unusual shape. For example, FIG. 23 shows a container 214 which is formed to resemble the shape of a sea shell. Other than the shape, the embodiment of FIG. 23 is like that illustrated and described in connection with the previous drawings. More particularly, it will be seen that the container 214 includes two container halves 216, 218 joined by a resilient hinged connector 220 which has a ring member 222 and a partial segment 224 joined by a hinge 226. Both the ring member 222 and the partial segment 224 are shaped to match the peripheral shape of the container. The ring member has an upper channel 228 for receiving less than all sides of the formed edge 217 of the container lid 216, leaving the hinge side free for attachment to the partial segment 224.

It will be appreciated that the invention is especially advantageous for forming containers with fanciful, irregular, shapes which tend to be more expensive to make than containers with conventional simple shapes. This is because identical container halves can be used to form a container. Thus, drawing and forming equipment can be configured and set up to draw a large number of identical container halves, thereby reducing the fixed cost of the container.

The description thus far has focused on the advantageous use of the present invention which allows two container halves with simple formed edges that normally would not interfit and has no provision for hinged connection to be joined together to form a hinged container. It will be appreciated, however, that the identity of the formed edges is not a requirement of the present invention. Indeed, it will be appreciated that another important application of the present invention is in converting a conventional non-hinged container with interfitting container halves into a hinged container.

Figure 24:
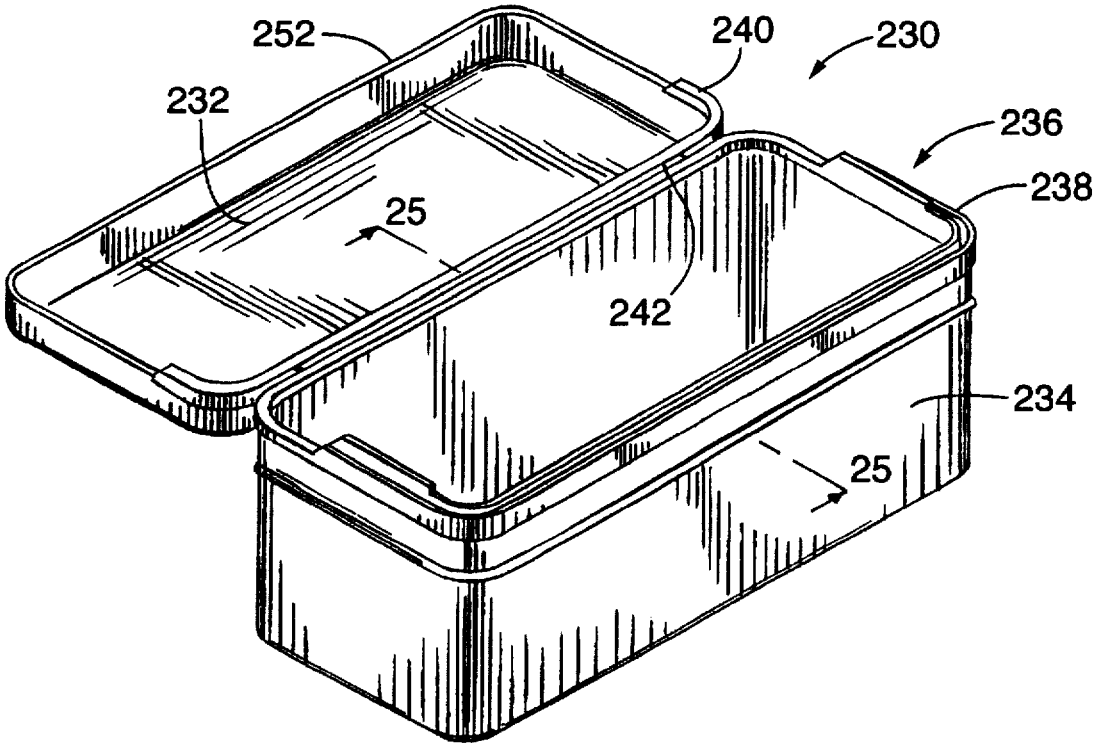
FIG. 24 is a perspective view of a hinged container converted from a conventional non-hinged container.

An example of this application is illustrated in FIG. 24. As illustrated, the container 230 includes a container lid 232, a container bottom 234, and a hinged connector 236 joining the lid and bottom to form a hinged container. Similar to the embodiments described above, the hinged connector 236 has a ring member 238 attached to the container bottom, a swingable partial segment 240 gripping the container lid, and an integrally formed hinge 242 joining the ring member and the partial segment. As shown in the cross sectional view of FIG. 25, the ring member 238 has a lower channel 246 for receiving the formed edge 248 of the bottom, and an upper channel 250 for receiving the formed edge 252 of the lid 232. The partial segment 240 also has a channel 254 for gripping the formed edge of the container lid.

The main difference between this embodiment and the previously described embodiments is that the container halves in this case do interfit and may form a closed, non-hinged container without the aid of the connector 236. Because the container halves interfit, the formed edges 252, 248 of the container lid 232 and bottom 234 are necessarily different, and the ring member 238 and the partial segment 240 are adapted to receive the respective portions of the two non-identical formed edges.

In the present embodiment, the container top 232 has an outwardly turned curled edge 252, and the container bottom 234 has an inwardly folded hemmed edge 248, as is typical for conventional, non-hinged containers. Thus, the upper channel 250 of the ring member 238 and the channel 254 of the partial segment 240 are configured for receiving the curled edge 252 of the lid, and the lower channel 246 of the ring member is configured to receive the hemmed edge 248 of the bottom 234. To firmly attach the partial segment 240 to the container lid 232, the channel 254 of the partial segment is provided with nibs 256 and crush ribs 258 for gripping the formed edge of the lid. Similarly, the lower channel 246 of the ring member is provided with nibs 260 for securely gripping the hemmed edge 248 of the container bottom. In contrast, the upper channel 250 has crush ribs 262 formed therein to provide a snug frictional fit to the wall of the container lid adjacent the formed edge 252 of the lid.

Figure 26:
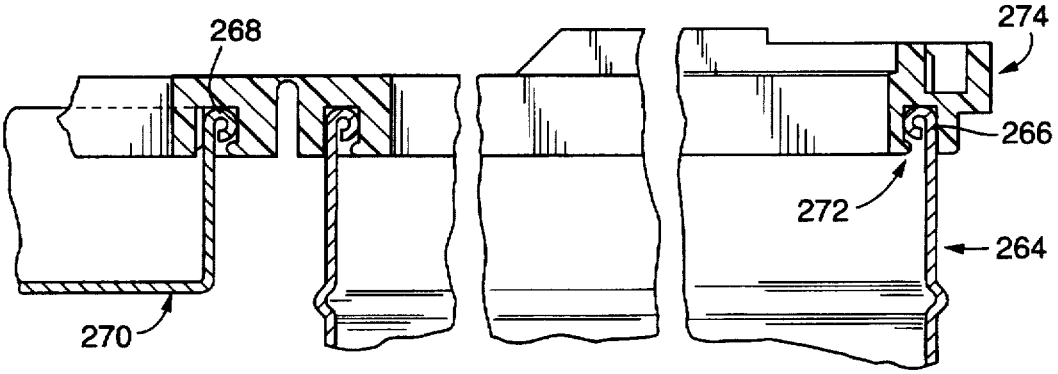
FIG. 26 is a fragmentary cross sectional view similar to FIG. 25 showing another alternative embodiment of the invention joining a container lid to a container bottom which has an inwardly curled edge.

Besides the combination of an outwardly turned curled edge on the lid and a hemmed edge on the bottom, the hinged connector can be adapted to join other combinations of interfitting formed edges. For example, FIG. 26 shows another embodiment which uses a container bottom 264 with an inwardly turned curled edge 266 which interfits the outwardly turned edge 268 of the lid 270. The lower channel 272 of the ring member 274 is accordingly configured to receive the inwardly curled edge 266 of the bottom.

Figure 25:
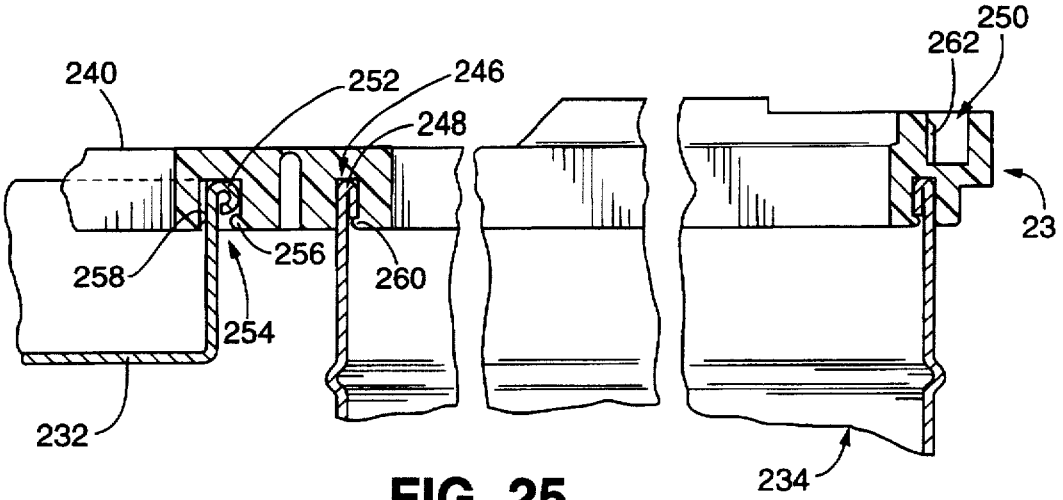
FIG. 25 is a fragmentary cross sectional view on an enlarged scale of the container in FIG. 24.
Figure 27:
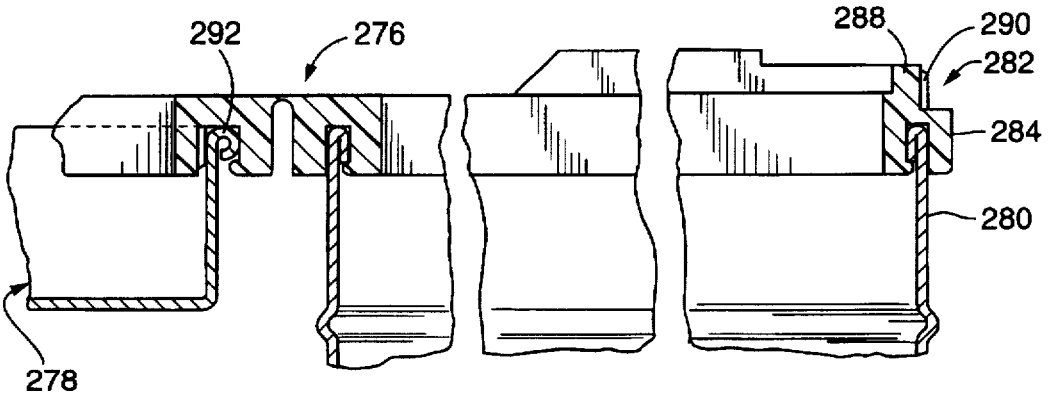
FIG. 27 is a fragmentary enlarged cross sectional view similar to FIG. 25 showing a further embodiment of the invention.

FIG. 27 shows a further embodiment of a hinged connector 276 for joining two interfitting container halves 278, 280 which are similar to those in FIG. 25. In this embodiment, the upper seat 282 of the ring member 284 has only one upstanding wall 288, instead of two walls forming a channel. The wall 288 has crush ribs 290 for providing a snug fit to the flat inner side of the outwardly turned edge 292 of the container lid 278.

It is not possible to be exhaustive at this point, since the possibilities which are presented by the present invention will be seen to be very broad indeed. It will be appreciated, however, that what has been provided is a resilient hinged connector which can be advantageously used to connect normally non-interfitting metal container halves with simple formed edges to form a hinged container. The hinged connector can also be advantageously used to convert conventional non-hinged containers into hinged containers. The use of the hinged connector eliminates the need to form hinge components directly on the metal container halves, resulting in much simpler metal processing required to form the container halves. The hinged connector can be shaped to match complex and irregular container peripheral shapes for forming containers of fanciful and commercially attractive designs. The connector further provides the opportunity to form special purpose containers with ornamental or functional internal or external features.

What is claimed is:

1. A metal container comprising the combination of: a container lid and a container bottom each having a closed end and a side wall terminated in a formed edge, the formed edges of the container lid and bottom defining a peripheral container shape; and a resilient connector shaped to match the peripheral container shape and having seats sized to fit the formed edges of the container lid and bottom for forming a closed container, the connector having a ring member, a partial segment, and an integrally formed hinge joining the ring member and the partial segment, the ring member being substantially continuous about the periphery and having a down-facing seat for engaging the formed edge of the container bottom, and an up-facing seat for engaging fewer than all sides of the formed edge of the container lid, leaving at least one side of the formed edge of the container lid free, the partial segment having an up-facing seat for securely gripping at least the free side of the formed edge of the container lid, the hinge being positioned to close the container in a normal condition and allow the container lid to pivot about the hinge to open the container.

2. A metal container as in claim 1, wherein the formed edges of the container lid and bottom are identically formed.

3. A metal container as in claim 2, wherein the container lid and the container bottom are substantially identical.

4. A metal container as in claim 2, wherein the thermoplastic forming the connector is polypropylene.

5. A metal container as in claim 1, wherein the formed edges of the container lid and bottom are non-identical.

6. A metal container as in claim 1, wherein the connector is of molded thermoplastic.

7. A metal container as in claim 1, wherein the upper and lower channels have non-identical gripping characteristics such that the lower channel attaches to the container bottom more firmly than the upper channel to the container lid.

8. A metal container as in claim 1, wherein the lower seat includes a channel having gripping means for securely gripping the formed edge of the container bottom when inserted therein.

9. A metal container as in claim 1, wherein the seat of the partial segment includes a channel having gripping means for securely gripping the formed edge of the container lid when inserted therein.

10. A metal container as in claim 1, wherein the hinge of the connector is in the form of a flexible thin web.

11. A metal container as in claim 1, wherein the connector includes an integrally formed wedge supported on the ring member for prying apart the formed edges of the closed container to open the container.

12. A metal container as in claim 1, wherein the resilient connector further includes an integrally formed clasp pivotally connected to an outer periphery of the ring member, the clasp being movable into a locking position to prevent the formed edge of the container lid from being disengaged from the up-facing seat of the ring member.

13. A metal container as in claim 1, further including an integrally formed hanging tab attached to an outer periphery of the ring member.

14. A metal container as in claim 1, wherein the ring member includes an inner peripheral wall and an outer peripheral wall joined by a base web to form an upper channel serving as the upper seat for receiving the formed edge of the container lid and a lower channel serving as the lower seat for receiving the formed edge of the container bottom.

15. A metal container as in claim 14, wherein the ring member includes a latch section having an integrally formed release tab depending from the outer peripheral wall and a detent nib protruding from the outer peripheral wall into the upper channel for capturing the formed edge of the container lid, and wherein the outer peripheral wall twists to disengage said detent nib from the formed edge of the container lid when the release tab is pushed so as to facilitate the opening of the container.

16. A metal container as in claim 1, wherein the container lid and bottom are of a non-rectangular peripheral shape, the hinged connector being a plastic member injection molded to match the non-rectangular peripheral shape.

17. A metal container as in claim 1, wherein the formed edges are formed in the shape taken from the class including inwardly and outwardly formed curled, teardrop-shaped, and hemmed edges.

18. A metal container as in claim 1, wherein the connector includes at least one internal feature unitarily molded with the hinged connector and positioned to be entirely disposed within the container.

19. A metal container as in claim 1, wherein the connector is formed with at least one integral external feature unitarily extending from the connector to be disposed outside the container.

20. A metal container comprising the combination of:

a container lid and a container bottom formed of drawn metal each having a closed end and an upstanding wall terminated in a formed edge, the formed edges of the container lid and bottom being substantially identical and defining a peripheral container shape; and a unitary hinged connector formed of molded thermoplastic for joining the container lid and bottom at their respective formed edges to produce a closed container, the hinged connector including a fixed ring and a swingable segment formed to match the peripheral container shape for receiving the formed edges, and a hinge web joining the fixed ring and the swingable segment, the hinge web being flexible to allow pivotal movement of the swingable segment relative to the fixed ring, the fixed ring having:

a fixed base separating a down-facing lower seat for receiving the formed edge of the container bottom and an up-facing upper seat for receiving less than all sides of the formed edge of the container lid, leaving at one side of the formed edge of the container lid free, the fixed base having an up-facing open section for receiving the swingable segment, the swingable segment having a swingable base which overlies the open section of the fixed base when the swingable segment is pivoted to a closed position, and an up-facing seat on the swingable base for securely gripping the free side of the formed edge of the container lid so that when the swingable segment is in the closed position the seat thereon cooperates with the upper seat on the ring member for receiving the formed edge of the container lid.

21. A metal container as in claim 20, wherein the upper and lower seats on the fixed ring have non-identical gripping characteristics such that the lower seat attaches to the container bottom more firmly than the upper channel to the container lid.

22. A metal container as in claim 20, wherein the container lid and the container bottom are substantially identical.

23. A metal container as in claim 20, wherein the hinged connector includes an integrally formed wedge supported on the fixed ring for prying the formed edge of the container lid out of the upper seat.

24. A metal container as in claim 20, wherein the hinged connector includes an integrally formed clasp pivotally connected to the fixed ring, the clasp being movable into a locking position to prevent the formed edge of the container lid from being disengaged from the upper seat of the fixed ring.

25. A metal container as in claim 20, wherein the fixed ring includes an inner peripheral wall and an outer peripheral wall joined by the fixed base to form an upper channel and a lower channel serving respectively as the upper and lower seats.

26. A metal container as in claim 25, wherein the fixed ring has a latch section including an integrally formed release tab depending from the outer peripheral wall and a detent nib protruding from the outer peripheral wall into the upper channel for capturing the formed edge of the container lid, and wherein the outer peripheral wall twists to disengage said detent nib from the formed edge of the container lid when the release tab is pushed so as to facilitate the opening of the container.

27. A hinged connector of molded thermoplastic for joining a metal container lid and a metal container bottom to form a hinged container, the container lid having a formed edge of a first given size and shape, the container bottom having a formed edge of a second given size and shape that matches the formed edge of the container lid, the formed edges defining a peripheral container shape, the hinged connector comprising:

a ring member and a partial segment joined by an integrally formed hinge, the ring member and the partial segment being shaped to match the peripheral container shape, the ring member having a down-facing lower seat for receiving a formed edge of said second size and shape, and an up-facing upper seat for receiving a formed edge of said first given size and shape, the upper seat extending along fewer than all sides of the ring member, leaving at least a hinge side of the ring member free;

the partial segment being joined to the hinge side of the ring member by the hinge and having an up-facing seat for securely gripping a formed edge of said first given size and shape, the hinge member being flexible to allow the partial segment to be pivoted into a closed position in which the partial segment overlies the hinge side of the ring member such that the seat of the partial segment and the upper seat of the ring member cooperate to receive corresponding portions of a formed edge of said first given size and shape.

28. A hinged connector as in claim 27, wherein the first size and shape is substantially identical to the second size and shape.

29. A hinged connector as in claim 27, wherein a formed edge of said first size and shape interfits a formed edge of said second size and shape.

* * * * *